United States Patent [19]

Bellem

[11] 4,058,949

[45] Nov. 22, 1977

[54] BUILDING ROOF INSULATION

[75] Inventor: Norman A. Bellem, Kansas City, Mo.

[73] Assignee: Butler Manufacturing Company, Kansas City, Mo.

[21] Appl. No.: 717,348

[22] Filed: Aug. 24, 1976

[51] Int. Cl.[2] ..... E04B 2/00

[52] U.S. Cl. ..... 52/407; 52/478

[58] Field of Search ..... 52/404, 406, 407, 409, 52/478, 479, 483, 481, 743

[56] References Cited

U.S. PATENT DOCUMENTS

| | | | |
|---|---|---|---|
| 2,174,988 | 10/1939 | Lunduall | 52/407 |
| 2,256,961 | 9/1941 | Pearson et al. | 52/407 |
| 2,326,717 | 8/1943 | Zeidler | 52/407 |
| 2,540,331 | 2/1951 | Hlavaty | 52/407 X |
| 2,799,232 | 7/1957 | Jaeger | 52/409 |
| 3,296,761 | 1/1967 | Varlonga | 52/409 |
| 3,662,509 | 5/1972 | Studzinski | 52/404 |

*Primary Examiner*—J. Karl Bell

*Attorney, Agent, or Firm*—Shoemaker and Mattare, Ltd.

[57] ABSTRACT

Insulation for the roof of a building. The insulation comprises a plurality of distinct layers of flexible insulation blankets with a spacer channel member interposed therebetween. A spacer block can be included to space the top layer of insulation from a roof panel at a location adjacent a purlin. The spacer member is channel-like and is generally U-shaped in transverse cross-section and is adaptable to be used in conjunction with a variety of purlin shapes.

15 Claims, 9 Drawing Figures

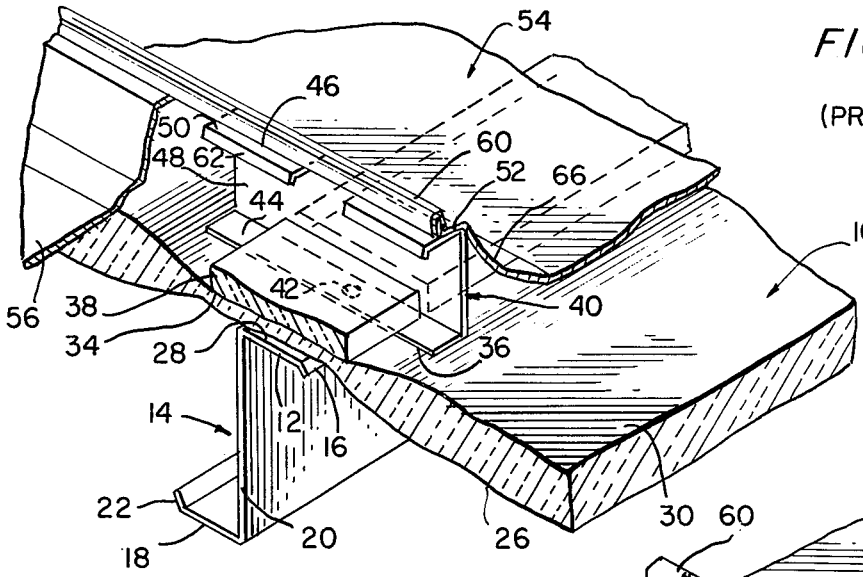
FIG. 1.
(PRIOR ART)
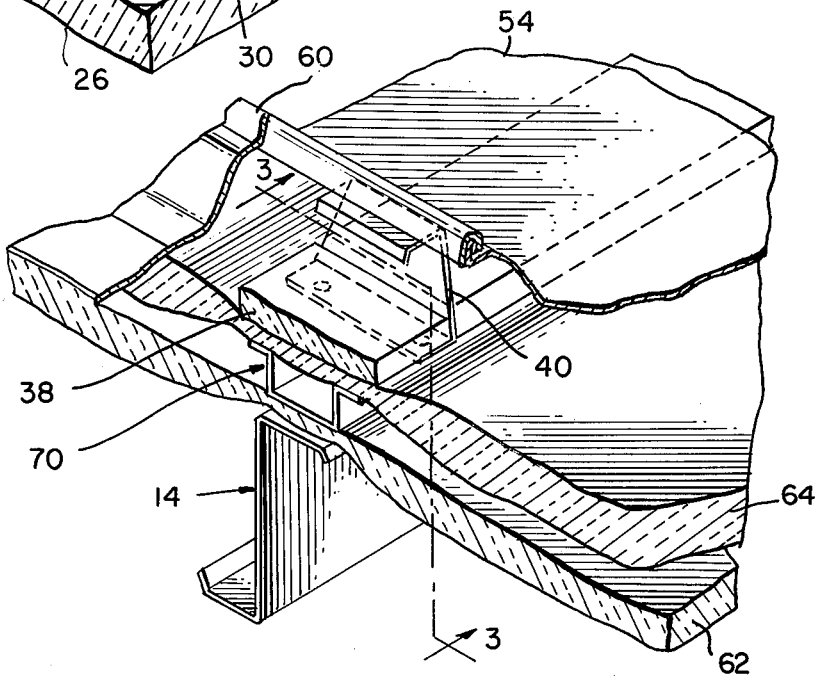
FIG. 2.
FIG. 3.
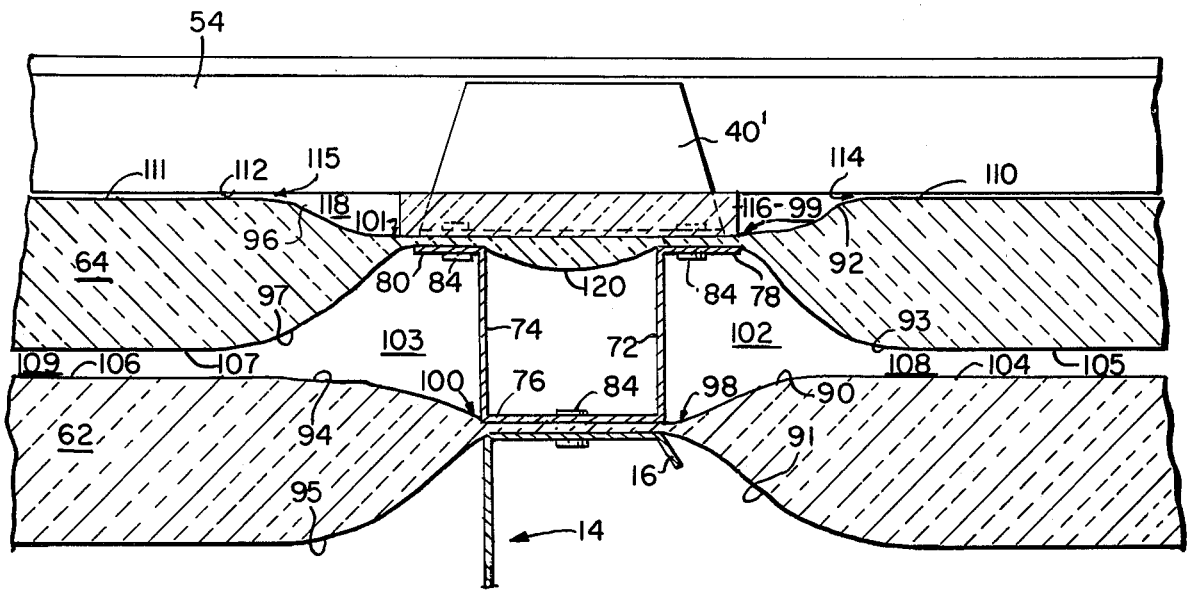

BUILDING ROOF INSULATION

BACKGROUND OF THE INVENTION

The present invention relates to building roofs, and more particularly, to thermal insulation therefor.

The ever increasing cost of energy forces building designers to become acutely aware of building insulation structure and the effectiveness thereof. A poorly insulated building can be costly in terms of heating and cooling expenses, as well as costly in terms of lost work hours due to employee discomfort.

In highrise buildings, it has been discovered that the major heat loss therefrom occurs from the walls, whereas in lowrise buildings, it has been found that the major heat loss occurs therefrom through the roof. Thus in lowrise buildings, roof design is a major consideration in building design, and the roof insulating means is a major element in controlling the overall energy costs of the lowrise building.

Known lowrise buildings have a roof insulating configuration formed of a single layer of insulation comprised of a plurality of panels of flexible insulation, such as glass fiber blankets, laid end-to-end and stretched over structural members, such as roof purlins, just prior to positioning and fastening the roof panels to the purlins. The single layer of insulation is compressed or pinched between the purlin and roof panel at each purlin, and the thus distorted insulation has a heat path therethrough having a thermal resistance which is reduced from a heat path through undistorted insulation, i.e., a "thermal weakness" exists adjacent the purlins. Accordingly, because of this "thermal weakness", much heat energy can be lost through the insulated roof at, or near, the purlins. Furthermore, in view of the need for efficient and effective building thermal designs, even at positions spaced from the purlins, a single layer of insulation may prove to be inadequate.

Simply increasing the thickness of the single layer of insulation does not provide a complete answer, as thick insulation is difficult to handle and this solution is not efficient enough to offset the problems attendant therewith. Furthermore, thick layers of insulation blankets may cause the fasteners used to connect the roof panels to the purlins through the insulation to dimple the roof panels, and possibly to become loosened after a period of time. Therefore, practical considerations limit roof insulation configurations to panels of 3 to 4 inches in thickness.

One construction which has been proposed for increasing the thermal resistance in the heat path adjacent the roof purlins, without increasing the thickness of the insulation blankets used, includes a thermal spacer block interposed between the insulation and the roof panel. The spacer block can be constructed of insulating material and does somewhat improve the thermal resistance of the heat path through the insulation adjacent the purlins. However, such a construction still utilizes only a single layer of insulation, and as insulation requirements continue to increase, even such spacer blocks will not provide a complete solution to the problems of providing adequate insulation in an economical and workable manner, and thus further solutions are required.

There is one structure proposed for insulating a building roof which includes a U-shaped cap member placed over a purlin to support an insulation panel. However, the insulation panel is still only a single layer thick and this single layer is pinched between the purlin and the roof. There is no compensation made for this reduced insulation thickness. Because of this, the thermal resistance of the insulation of this configuration is still inadequate to meet today's demand for efficient, economical and practical roof insulation.

Accordingly, the present invention provides an insulation configuration which includes a plurality of discrete layers of insulation which are separated at a purlin by a spacer channel.

SUMMARY OF THE INVENTION

The insulation construction embodying the teachings of the present invention is thermally efficient and is easily handled.

The insulation construction embodying the preferred form of the present invention comprises two discrete insulation blankets layered on top of each other and separated by a U-shaped spacer channel member interposed therebetween. The channel member is elongate and extends longitudinally of the roof purlin. In one embodiment, the U-shaped channel is upwardly open and is suitable for use in conjunction with a Z-purlin, and in another embodiment, the channel is downwardly open and is suitable for use in conjunction with a truss purlin. Furthermore, the channel can be used with or without a spacer block which separates the top insulation layer from the roof panel in the vicinity of the roof purlins. Thus, the spacer channel member is amenable to use with a variety of roof purlins, and thus a single channel design is adaptable to a variety of building constructions. A single channel design can thus be mass produced economically.

At least two advantages result from using multi-layered insulation for the roof insulation configuration. The plurality of discrete layers form a plurality of surfaces in any heat path from the building interior to the roof panels. Such surfaces increase the thermal resistance of this heat path over that thermal resistance of a similar heat path without surfaces located between the end points thereof. Thus, two discrete layers of 3 inch insulation will have a thermal resistance which is greater than a single 6 inch layer of that same insulation. In fact, tests have proven that the two-layered insulation configuration of the preferred form of the present invention has a thermal resistance which is approximately 55 percent greater than that of a single layer of that same insulation having a thickness equal to the combined thickness of the multi-layered constructions (a "U" factor for 0.6 lb/ft$^3$ density insulation which dropped from 0.076 Btu/hr/ft$^2$/F° to 0.049 Btu/hr/ft$^2$/F°, where U is proportional to 1/R, and R is taken as the thermal resistance).

Another advantage of using multi-layered insulation results because handling two thin layers of insulation is often easier than handling one single thick layer of insulation. Thus, two insulation layers, each 3 inches thick, will be easier to handle than a single insulation layer 6 inches thick. It is noted that the length of an insulation layer is normally predetermined to be of one continuous length of insulation from eaves to eaves, or at least from eaves to ridge on wide buildings.

Preferably, the insulation configuration embodying the present invention is used on pre-engineered metal buildings.

OBJECTS OF THE INVENTION

It is, therefore, a main object of the present invention to increase the thermal efficiency of roof insulation configurations.

Another object of the present invention is to provide roof insulation which is easily handled.

A further object of the present invention is to provide a roof insulation configuration which can be used in association with a variety of purlin types.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 1 is a cutaway perspective showing a roof insulated according to the teachings of the prior art.

FIG. 2 is a cutaway perspective showing a roof insulated using a construction embodying the teachings of the present invention.

FIG. 3 is a sectional elevation taken along line 3—3 of FIG. 2.

DETAILED DESCRIPTION OF THE PREFERRED EMBODIMENTS

Figure 4:
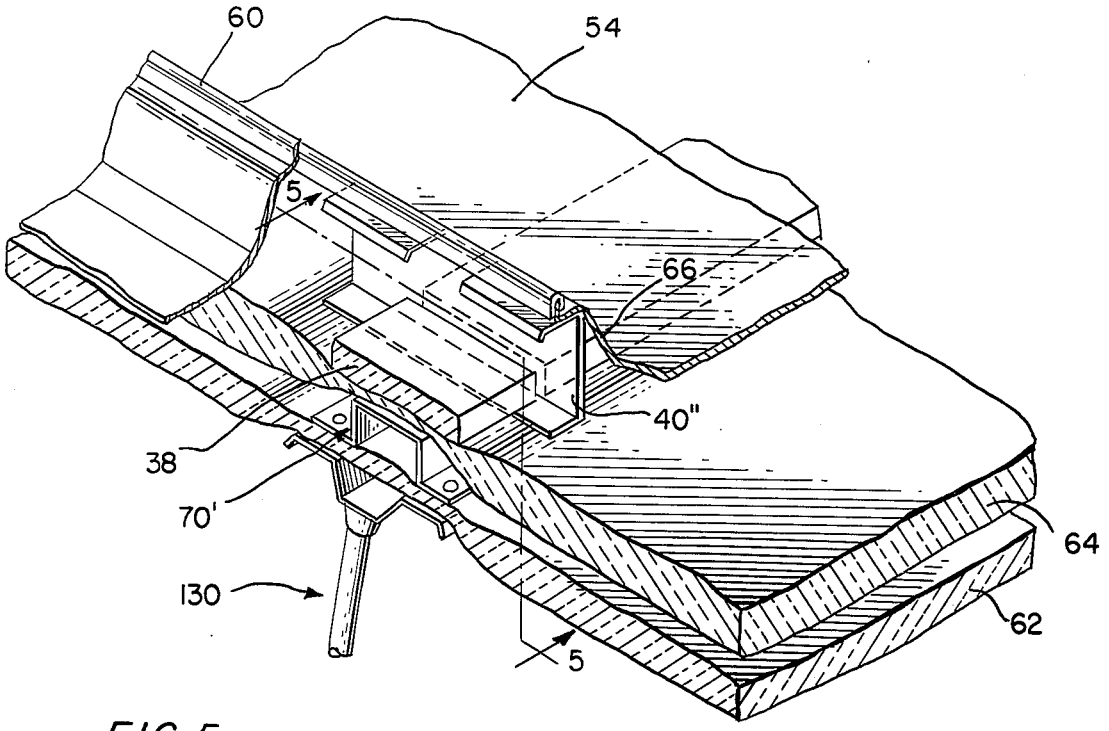
FIG. 4 is a cutaway perspective showing a roof insulated using a further embodiment of the present invention.

Shown in FIG. 1 is a section of a roof wherein a blanket 10 of flexible insulation with a vapor barrier thereon is mounted on an upper flange 12 of a Z-shaped purlin 14. The upper flange 12 has a lip 16 depending from a free marginal edge thereof and is connected to a base flange 18 by a central web 20. The base flange 18 also has a lip 22 on a free marginal edge thereof. Undersurface 26 of the insulation blanket 10 is seated on upper surface 28 of the flange 12, and top surface 30 of the blanket 10 is pressed against lower surfaces 34 and 36 of an elongate thermal spacer block 38, and a panel clip 40, respectively. The panel clip 40 extends transversely of the purlins, and is essentially C-shaped and is connected to upper face 28 of the flange 12 by an attaching means, such as a fastener 42, interconnecting a lower flange 44 of the clip and upper flange 12 of the purlin with blanket 10 intermounted or trapped therebetween. A top flange 46 of the clip 40 is connected to the lower flange 44 by a central web 48 and has an upper surface 50 supporting a flat top 52 of a corrugated roof panel 54 which is connected to an adjacent roof panel 56 by a standing seam 60 located on the top 52. A lip 62 depends from a free marginal edge of the top flange 46 and is angularly disposed with respect thereto to generally match the angle of the sloping sides 66 of the panel ribs.

The thermal spacer block 38 extends longitudinally of the purlin 14 and is mounted on the lower flange of clip 40. The insulation blanket becomes deformed and compressed where it is trapped between the purlins and the roof panels. At those locations, the heat transfer through the blanket can increase. By interposing a spacer block between the roof panel and the purlin, the thermal resistance of this heat path is increased over that resistance of a path formed by direct contact between the deformed insulation blanket and a roof panel. The spacer block can be formed of insulating materials.

As building insulation requirements increase, even devices such as spacer blocks 38 may not provide a complete answer to the problems associated with building thermal energy losses.

Shown in FIG. 2 is a means for further increasing the thermal resistance of the heat path between a building interior and the roof panels thereof, to thereby decrease building thermal energy losses. As shown in FIG. 2, the roof panel 54 is separated from the top of the purlin 14 by a plurality of layers of discrete insulation blankets, such as blankets 62 and 64. Building insulation comprised of a plurality of discrete insulation blankets formed into a stratified, multi-layered body increases the thermal resistance of the heat path through that insulation by providing a plurality of surfaces across which heat must pass to flow between the end points of the thermal path. Because of the special thermal resistances associated with heat transfer from one surface to another discrete surface, for the same temperature gradient, material thermal properties and spacial relations between the path end points, a thermal path having a plurality of surfaces located between the end points thereof will have a thermal resistance in excess of that thermal resistance of a path having no surfaces intervening between the end points thereof. Preferably, the insulation blankets 62 and 64 are each approximately 3 to 4 inches thick. In addition to the increased thermal resistance associated with the multi-layered configuration shown in FIG. 2, it has been found that laying two 3 inch blankets is easier than laying one 6 inch blanket.

As above discussed, the insulation blanket will be deformed in the vicinity of the purlin. This phenomenon is present even when a plurality of insulation blankets are used, with each blanket being pinched between the purlin and the roof panel. Thus, even in a configuration having a plurality of distinct layers of insulation blankets, the thermal path in the vicinity of the purlin has a lower thermal resistance than that path spaced from the purlins, albeit, a greater overall thermal resistance than a single layer of insulation. As also discussed above, a spacer block 38 will improve the heat resistance of the path. However, the roof insulation configuration embodying the teachings of the present invention improves the thermal resistance of the heat path even further by including a spacer member between the insulation layers contacted by the purlin. Thus, as shown in FIG. 2, the structure embodying the present invention includes an insulation spacer channel member 70 which is interposed between insulation blankets 62 and 64 at a location adjacent the purlin 14.

As shown in FIGS. 2 and 3, the spacer member 70 is elongate and generally U-shaped in transverse cross-section, and extends longitudinally of the purlin to which it is affixed. The member 70 comprises a pair of legs 72 and 74 oriented to be in spaced parallelism with respect to each other and each integrally connected to a base portion 76 which interconnects the legs 72 and 74. A pair of oppositely projecting coplanar wings 78 and 80 are integrally connected to the free ends of the arms and project outwardly of the member 70 to form attaching flanges. Hold down means, such as fasteners 84, affix the member 70 to the purlins 14 and to a clip 40' with the insulation blankets 64 pinched between the wings and the clip, spacer block or roof panels, and insulation blanket 62 is pinched between the base and the purlin. The clip 40' is similar to the clip 40, but is formed to conveniently receive fasteners 84, as shown in FIG. 3.

As shown in FIG. 3, each of the blankets is pinched by the member 70, the purlin, the roof panel or the thermal block 38, or the clip to form curved shoulders 90–97 which intersect to form pinched necks 98–101 adjacent the wings and the base, and thus define cavities or channels 102 and 103. The shoulders generally diverge away from the pinched necks and each merge into spaced apart facially opposed surfaces 104, 105, 106 and 107 which define thermal gaps 108 and 109 therebetween. As shown in FIG. 3, the top surfaces 110 and 111 of the blanket 64 can be spaced from undersurface 112 of the roof panel to define gaps 114 and 115. Further gaps 116 and 118 are defined by the shoulders and the undersurface 112 adjacent the spacer block 38. The insulation blanket 64 also sags into a crown 120 between legs 72 and 74 of the channel member 70.

The plurality of surfaces, as above discussed, increases the thermal resistance of any path through the insulation to the roof panels. A thermal path which includes the fasteners and/or pinched necks of the blankets still has a higher thermal resistance than one through a single insulation layer, and thus, even though the blankets are pinched, the thermal energy losses associated with multi-layered insulation are less than those associated with single layer insulation. Even if the heat travels through the fasteners, the cross-sectional areas of those fasteners are quite small and the overall thermal resistance of the thermal path is not significantly altered. The multiple surface configuration again improves the overall thermal resistance of the path. The wide spacing between the blankets caused by the spacer channel further improves the thermal resistance of the insulation layer.

Figure 5:
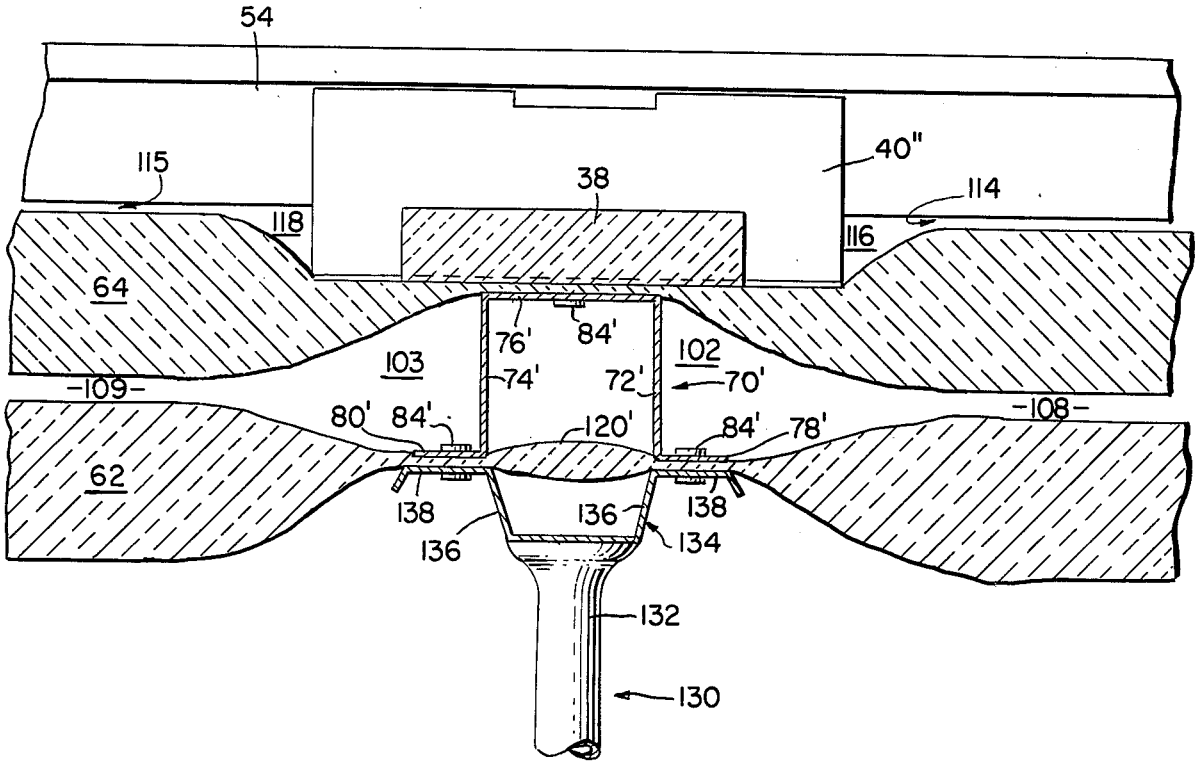
FIG. 5 is a sectional elevation taken along line 5—5 of FIG. 4.

An alternative embodiment of the present invention is shown in FIGS. 4 and 5 and includes a spacer member 70' shaped similarly to the FIGS. 2 and 3 embodiment, but oriented to be inverted from that orientation of the FIGS. 2 and 3 embodiment. The inverted spacer has legs 72' and 74' integrally interconnected by a base 76' and which have wings 78' and 80' thereon, and which is attached to a truss purlin 130 which is generally, though not actually, T-shaped in cross-section and which has a central body 132 having a a generally U-shaped head 134. In reality, the truss purlin has a top which is generally a U-shaped head and has a lower core which is also a U-shaped head. The bottom of the truss purlin is not shown in the figures, but is similar to a typical bar joist type of configuration. The head 134 comprises a pair of diverging arms 136 each attached at one end thereof to the top of the body 132 and which have a flange 138 integrally attached to the free marginal edge thereof. The purlins are elongated and the flanges extend outwardly of the head 134 and longitudinally of the purlin. The top surfaces of the flange 138 are, like the lower surfaces of the wings 78 and 80, coplanar and are attached to a clip 40" by hold down elements, such as fasteners 84'. Again, the clip 40" is shaped to receive the hold down means associated with this embodiment. As in the FIGS. 2 and 3 embodiment, the roof is separated from the interior of the building by a plurality of insulation layers 62 and 64 which are interconnected by the spacer member 70' in a manner similar to that of the member 70. Again, the thermal path between the inside of the building and the roof panel is comprised of a plurality of surfaces with the attendant increase in thermal resistance over a path without surfaces intervening between the end points thereof.

Figure 6:
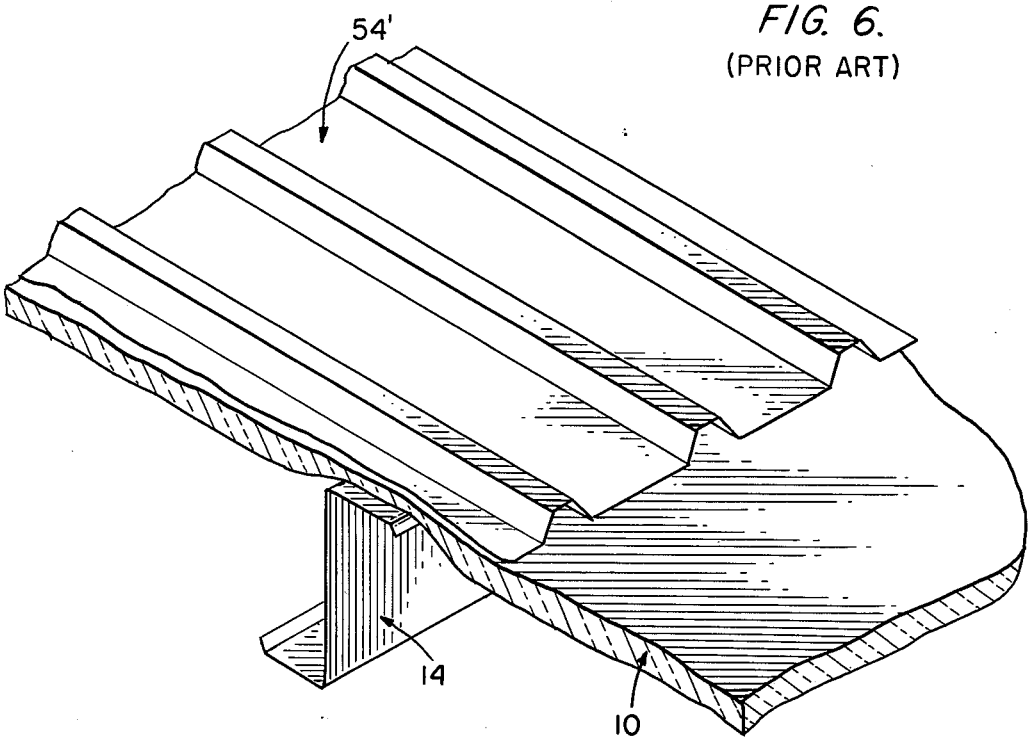
FIG. 6. (PRIOR ART)
FIGS. 6 and 7 are cutaway perspectives showing roofs insulated according to the teachings of the prior art.
Figure 7:
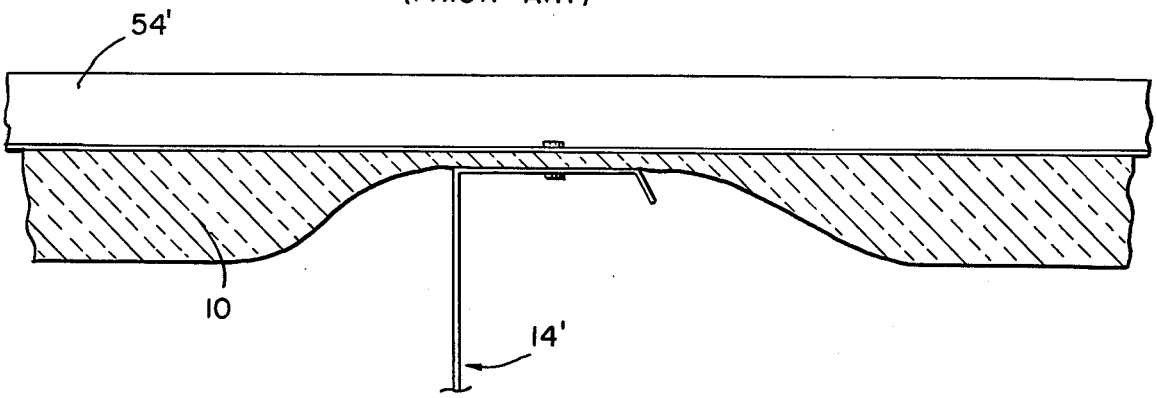
FIG. 7. (PRIOR ART)
Figure 8:
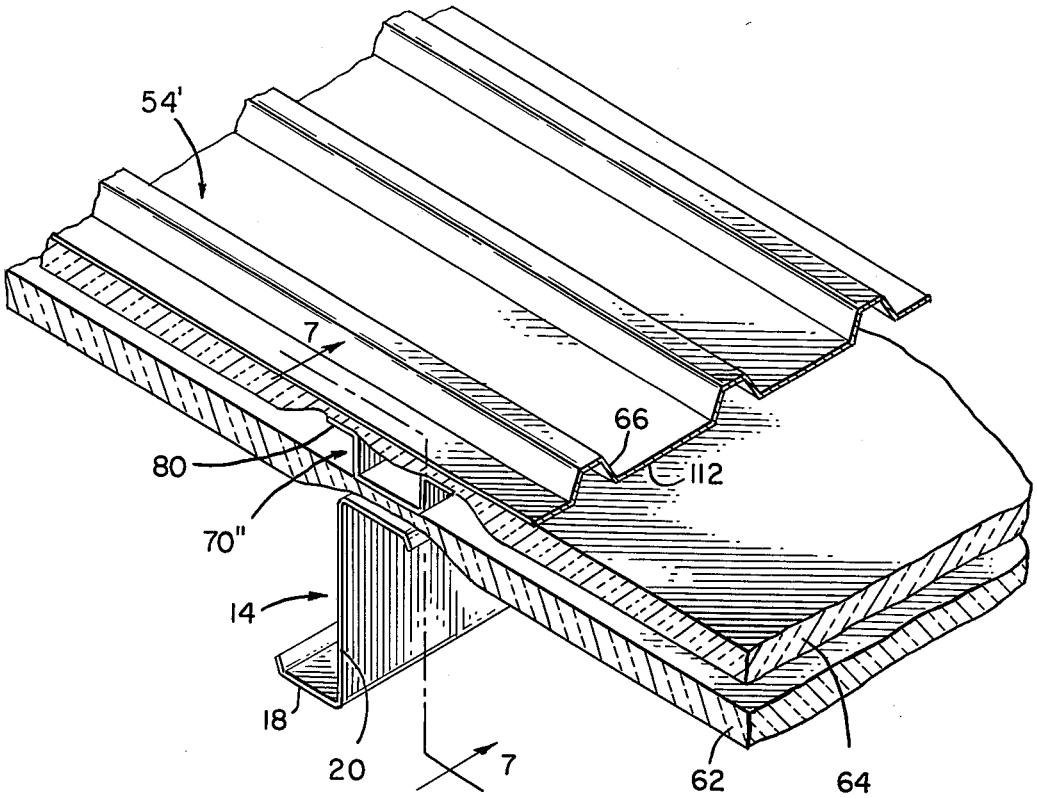
FIG. 8 is a cutaway perspective showing a roof insulated using a further embodiment of the present invention.
Figure 9:
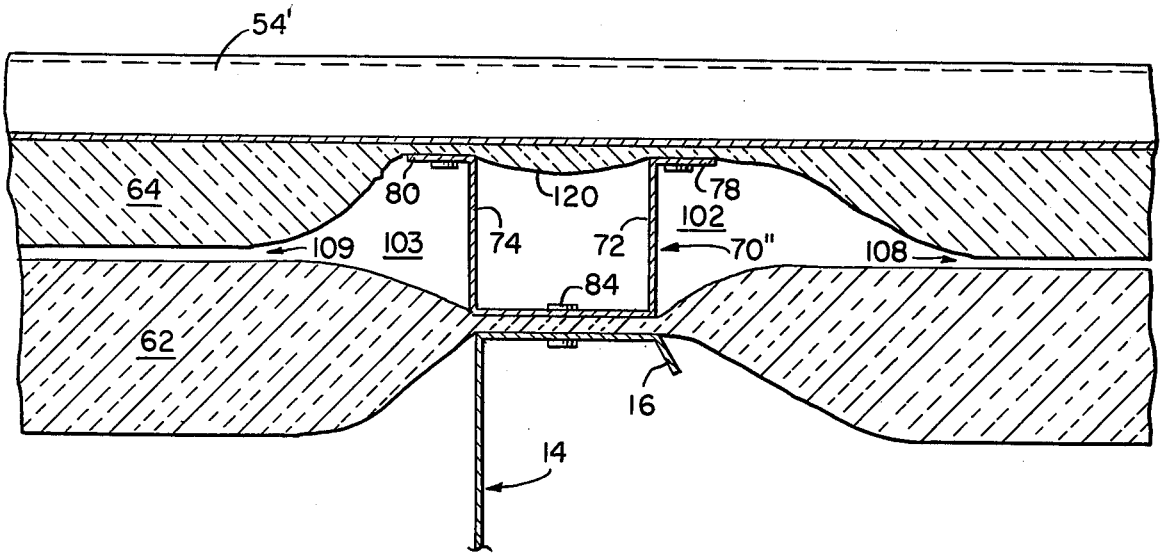
FIG. 9 is a sectional elevation taken along line 9—9 of FIG. 8.

Yet another embodiment of the present invention is shown in FIGS. 8 and 9, wherein a spacer member 70" is shaped and oriented similarly to member 70, and is interposed between insulation blankets 62 and 64. The teachings of the prior art are illustrated in FIGS. 6 and 7 wherein the spacer blocks are omitted and the insulation blanket 10 directly contacts roof panel 54' with the attendent thermal energy losses, as above-discussed in connection with FIG. 1. These figures show typical roofs embodying the teaching of the prior art. The FIG. 1 roof includes a spacer block, which as above discussed, produces an improvement in thermal performance of the roof. The roof shown in FIGS. 6 and 7 does not include a spacer block, and the inclusion of the multi-layer insulation and channel member will produce significant thermal energy savings when used in conjunction with the roof shown in FIGS. 6 and 7. As shown in FIGS. 8 and 9, the top surface of blanket 64 contacts undersurface 112 of the panel 54'. However, even though layer 64 contacts panel 54', there is a plurality of layers of insulation present, and hence a multiplicity of surfaces which produces an increased thermal resistance. Thus, using the teachings of the present invention results in significant savings in thermal energy, whether or not a spacer block is used. Furthermore, the roof need not be formed of a plurality of interconnected panels, but a single corrugated sheet 54', as shown in FIGS. 8 and 9. Either of the channel members 70 or 70' can be used in conjunction with the blankets shown in FIGS. 8 and 9, depending on the type of purlins used. The increased thermal resistance of the stratified, multi-layered insulation is often sufficient to provide adequate insulation to a building, in which case, the spacer block 38 is not required.

The invention has been disclosed herein as comprising two layers of insulation blankets, but can include more than two layers, if so desired. In any event, a multiplicity of surfaces is produced which increases the thermal resistance of the overall insulation configuration, in addition to being easier to handle.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. An insulated roof for a building, comprising:

a roof purlin supporting a roof panel;

a plurality of discrete insulation blankets layered one on top of the other and positioned between said roof purlin and said roof panel, said layers forming a plurality of surfaces to increase the thermal resistance of a heat transfer path between the building interior and said roof panel; and a spacer member interpositioned between a pair of contiguous ones of said layered insulation blankets to separate said pair of blankets from each other, said spacer member being connected to both said roof panel and said roof purlin.

2. The roof of claim 1, wherein said spacer member is integral and U-shaped and has a pair of legs, a base integrally connecting said legs, and a pair of oppositely extending flanges each integrally connected to one of said legs.

3. The roof of claim 2, wherein said spacer member has an open section presented toward said roof panel.

4. The roof of claim 2, wherein said spacer member has an open section presented toward said purlin.

5. The roof of claim 1, further including a spacer block positioned between said blankets and said roof panel and located adjacent said purlin.

6. The roof of claim 3, wherein said purlin is a Z-shaped purlin.

7. The roof of claim 4, wherein said purlin is a truss purlin.

8. The roof of claim 1, wherein said blankets are spaced from each other in the vicinity of the purlin to define gaps therebetween.

9. The roof of claim 1, further including a clip attaching said roof panel to said purlin.

10. The roof of claim 5, wherein said spacer block and said purlin are elongate and are longitudinally aligned with each other.

11. The roof of claim 1, wherein said spacer member and said purlin are each elongate and are longitudinally aligned with each other.

12. The roof of claim 5, wherein one of said blankets is adjacent said roof panel and spaced therefrom to define a gap therebetween.

13. The roof of claim 1, wherein said spacer member is located adjacent said purlin, said spacer member being connected to said pair of layers of insulation blankets.

14. The roof of claim 1, wherein said spacer member compresses said contiguous ones of said blankets in opposite directions to define at least one cavity interpositioned between said contiguous ones of said blankets adjacent said spacer member.

15. The roof of claim 14, including a pair of cavities each located on opposite sides of said spacer member.

* * * * *

Disclaimer 4,058,949.—*Norman A. Bellem*, Kansas City, Mo. BUILDING ROOF INSULATION. Patent dated Nov. 22, 1977. Disclaimer filed Aug. 8, 1978, by the assignee, *Butler Manufacturing Company*.

Hereby enters this disclaimer to claims 1 and 5 through 15 of said patent.

[*Official Gazette October 3, 1978.*]